United States Patent [19]

Klemm

[11] Patent Number: 4,527,641

[45] Date of Patent: Jul. 9, 1985

[54] PERCUSSION TOOL

[75] Inventor: Günter Klemm, Olpe, Fed. Rep. of Germany

[73] Assignee: Hydroc Gesteinsbohrtechnik GmbH, Fed. Rep. of Germany

[21] Appl. No.: 604,434

[22] Filed: May 1, 1984

Related U.S. Application Data

[63] Continuation of Ser. No. 355,382, Mar. 8, 1982, abandoned.

[30] Foreign Application Priority Data

Mar. 12, 1981 [DE] Fed. Rep. of Germany ..... 3109367

[51] Int. Cl.[3] ..... E21B 11/02; E21C 13/06

[52] U.S. Cl. ..... 175/92; 173/78; 175/413; 175/418

[58] Field of Search ..... 173/105, 133, 15, 17, 173/78; 175/413, 382, 414, 415, 417, 418, 336, 339, 92, 105, 107; 279/97

[56] References Cited

U.S. PATENT DOCUMENTS

| | | | |
|---|---|---|---|
| 1,717,271 | 6/1929 | Simmons | 175/105 |
| 1,814,296 | 7/1931 | Dean | 175/336 |
| 3,260,319 | 7/1966 | Conover | 279/97 |
| 3,342,532 | 9/1967 | Krekeler | 175/413 |
| 3,726,533 | 4/1973 | Lafferty, Sr. | 279/97 |
| 3,841,708 | 10/1974 | Kniff et al. | 175/413 |
| 4,222,446 | 9/1980 | Vasek | 175/413 |
| 4,321,974 | 3/1982 | Klemm | 175/92 |

*Primary Examiner*—Frank T. Yost
*Assistant Examiner*—Hien H. Phan
*Attorney, Agent, or Firm*—Diller, Ramik & Wight

[57] ABSTRACT

In a percussion tool for rock drilling there is used in place of the conventional, large bore crown a hammer body (18) carrying a great number of interchangeable small bore crowns (26a,26b). The impact of a hammer piston (22) is transferred to the hammer body (18) which contains a radially projecting thicker head (25) to which the bore crowns (26a,26b) are secured. If individual bore crowns are worn or damaged, they can be interchanged individually. Moreover, the bore crowns can be rotated so as to position corresponding other hard metal elements (33) into the marginal area of the percussion tool.

19 Claims, 6 Drawing Figures

PERCUSSION TOOL

Figure 1:
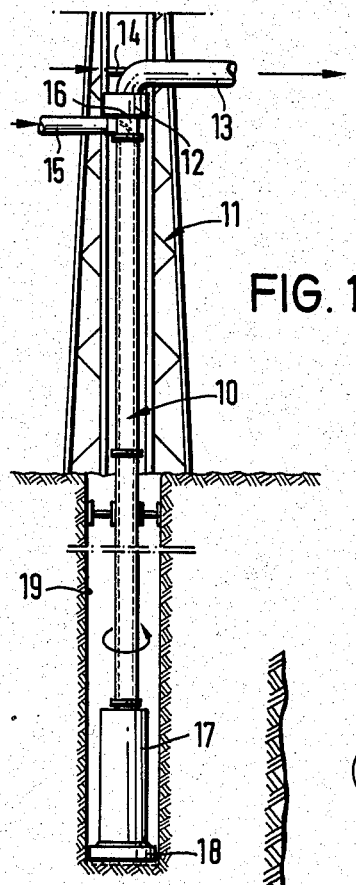

This application is a continuation of application Ser. No. 355,382, filed 3/8/82, abandoned.

The invention relates to a percussion tool to be mounted at a drill shaft containing a deep hole hammer, said percussion tool comprising a hammer body the one end of which is under the action of blows of the deep hole hammer while its opposite end is provided with hard metal elements engaging the bore hole bottom.

Normaly, rotary blow drilling devices comprise a hammer body in the form of a bore crown at the front end of the drill shaft. The rear end of the bore crown is under the action of the blows of a deep hole hammer and is rotated simultaneously. At its front side, it is provided with hard metal pins which, under the action of the blow device, are braking up the borehole bottom. Said borehole bottom and, above all the hard metal elements, are exposed to extremely high stresses. As a result, the bore crown is subjected to a relatively quick wear requiring frequent exchanges. For bore holes having a diameter of above 200 mm, the required bore crowns have to be large accordingly, and their production is very difficult for the following reasons:

If the bore crown body shall be stress-annealed, it is cooled more quickly externally than internally due to its bit mass, thus developing again material tensions. When the bore crown body is hardened, substantial material tensions are caused again, because the bore crown body is subjected to different cooling between the surface and the core during quenching and tempering. Subsequent to the production of the bore crown body, the hard metal elements are inserted by soldering which, as a result of the developing heat, again entails material tensions.

To avoid heat treatment required for fitting the hard elements by soldering, it has been known to provide bore fits at the final bore crown body to introduce by pressing ground hard metal pins, whose diameter is slightly superior to that of the bores, and they are introduced under high pressure. Due to the great number of hard metal pins, a considerable tension of material is caused, in particular in case of large crown bodies, in the surface thereof.

Material tensions which are practically unavoidable in the production of large bore crowns given rise to premature crack formation in crown bodies, when used, and to a failure of the bore crown.

It is the object of the invention to provide a percussion tool of the above mentioned type which can be produced in a relatively simple manner without substantial material tensions also with larger dimensions and which, by the possible replacing of individual elements, will not become useless in total in case of damages.

To solve the posed problem, it is provided according to the invention a. that the hammer body contains receiving means for the shafts of several bore crowns,
b. the bore crowns are fitted with heads thicker than the shafts and to which the hard metal elements are secured and
c. the hammer body and the bore crowns have impact transfer surfaces abutting against each other.

It is a considerable advantage of the invention that, instead of a sole bore crown used as a percussion tool, use is made of a hammer body at which several smaller bore crowns are adapted. The hammer body can be interchanged relatively simply and its life is much longer than that of the customary bore crowns. The hammer body by itself does not comprise any hard metal elements subjected to wear, but these are provided at the smaller bore crowns which can be interchanged individually.

By this means, it is possible to use for larger bore hole diameters of e.g. above 200 mm a hammer body at which smaller bore crowns available commercially, can be mounted. Due to the reduced material required for the smaller bore crowns, concentrations of tension can be avoided during their manufacture. Difficulties of production and the price of the bore crown increasing out of proportion with the increasing bore crown size, the use of several smaller bore crowns is more economic than the use of one sole large bore crown only.

In addition, the smaller bore crowns can be interchanged individually, when worn or damaged, thus doing away with the need of interchanging the total percussion tool in each case.

In case of large bore crowns made of one piece, wear primarily occurs at the hard metal elements fitted at the edge. Said marginal metal elements often break out accordingly if the bore crown penetrates into oblique rock layers of various degrees of hardness. As a matter of fact, specifically the hard metal pins in the outer position are temporarily under concentrated stress by the total impact energy. If the outer hard meal elements of a large bore crown are used up, the bore crown is useless.

The invention does not only offer the possibility of interchanging purposefully in such a case the smaller outer bore crowns, but, according to a preferred embodiment of the invention, the shaft of at least one bore crown is secured nonrotatingly to the hammer body, while it is insertable in different rotating positions. If the hard metal elements situated at the edge of the percussion tool are worn in part, it is possible to remove from its receiving means the corresponding bore crown for turning it to relocate it in the receiving means thus turning to the outer edge other hard metal elements being not yet worn so strongly.

According to another variant, the shaft of at least one bore crown is secured to the hammer body by being freely rotatable about its longitudinal axis. Due to forces developing in the operation, such a bore crown is slowly rotated thus resulting in a uniform wear of the hard metal elements.

Some embodiments of the invention are explained more closely hereinafter with reference to the drawings.

Figure 2:
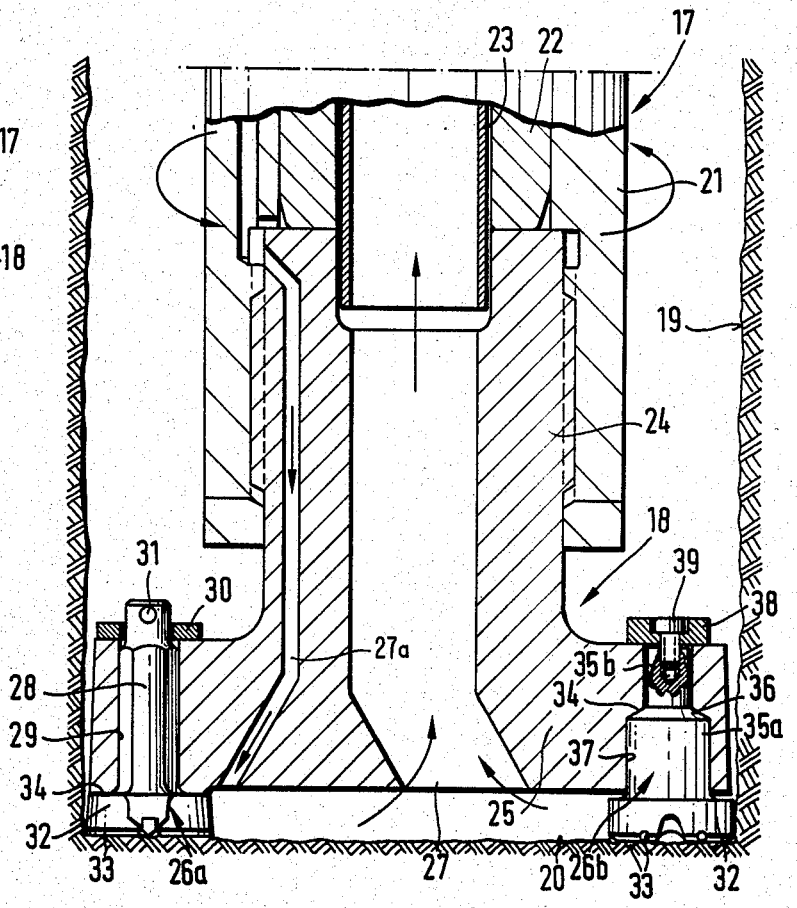
Figure 3:
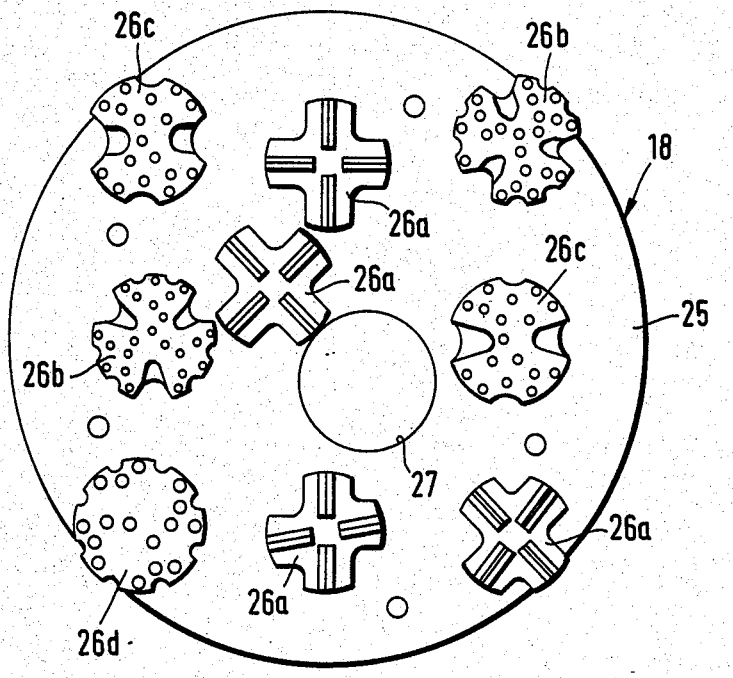
Figure 4:
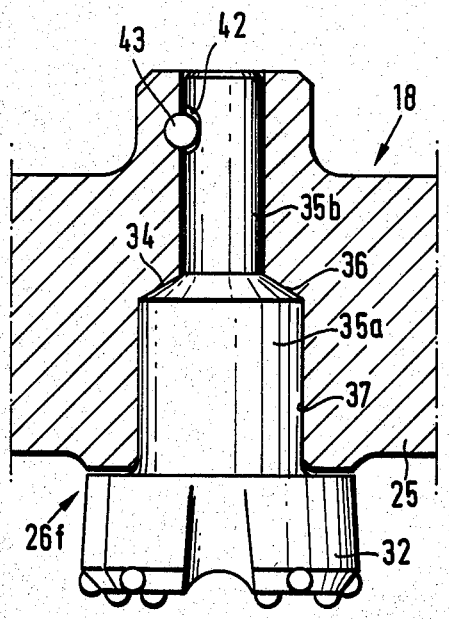
Figure 5:
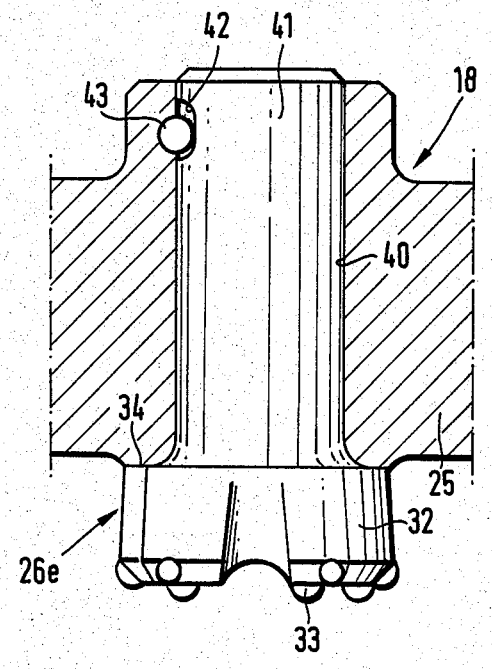
Figure 6:
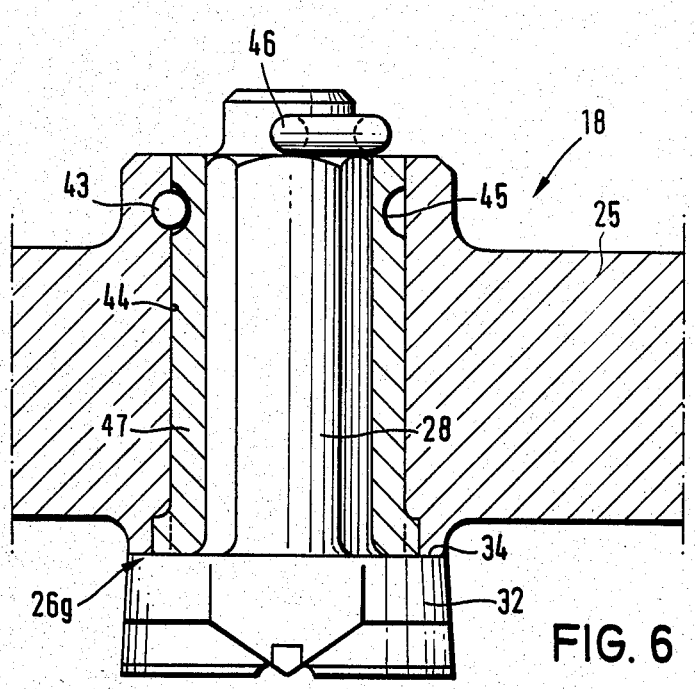

FIG. 1 is a schematic side view of a drilling device,

FIG. 2 is a longitudinal section of the front portion of the drilling device according to FIG. 1, FIG. 3 is a view of the percussion tool according to FIG. 2—seen from the borehole bottom, FIG. 4 shows the mounting of a bore crown at the hammer body, FIG. 5 is another embodiment of the mounting of a bore crown at the hammer body and FIG. 6 is another embodiment of the mounting of a bore crown at the hammer body.

The rock drilling device illustrated in FIG. 1 comprises a drill shaft 10 consisting of pipes and being guided above ground in a boring frame 11, a rotary drive 12 acting on its rear end. Behind the rotary drive, there is applied to the drill shaft 10 via a (non-illustrated) slide ring coupling a stationary ejection elbow 13 to discharge therethrough the drill material. An air nozzle by which, due to a Venturi effect, a vacuum is produced inside the drill shaft 10, ends in the elbow 13. The drill shaft 10 contains a (non-illustrated) internal pipe through which the drill material is flushed up. In the annular chamber between the internal pipe and the external pipe, there is compressed air fed via a conduit 15 and a slide ring coupling 16, and serving for the operation of the deep hole hammer 17 located at the front end of the drill shaft 10. The spent air escaping from the deep hole hammer 17 flows up in the internal pipe and serves as a flushing medium to convey the drill material. At the front end of the deep hole hammer 17, there is the percussion tool 18 which is explained more closely hereinafter with reference to FIG. 2.

The housing 21 of the deep hole hammer 17 is connected nonrotatingly with the rotating drill shaft 10. It contains an annular hammer piston 22 surrounding an internal pipe 23 and being periodically moved to and fro in axial direction. The control or compressed air drive for the hammer piston 22 have been known and are not explained in detail accordingly. Compressed air escaping from the deep hole hammer 17 is directed to the borehole bottom 20 through a passage 27*a* to serve for flushing up the drilled material through the internal pipe 23.

The hammer body 24 is screwed into the front end of the housing 21. The piston 22 strikes against the rear front side of the hammer body 24. At the front end of the shaft portion of the hammer body 18 which protrudes out of the housing 21, there is the hammer head 25 having a diameter superior to that of the housing 21. The hammer head 25 comprises a number of receiving means for smaller bore crowns 26*a*,26*b*,26*c* and 26*d*. In the embodiment of FIGS. 2 and 3, four different types of bore crowns are illustrated (FIG. 3) to show the many applicabilities. The aperture 27 facing the borehole bottom 20 for discharging the drill material and communicating with the inside of the internal pipe 23 is offset relative to the axis of the drill leg 10 thus enabling the bore crowns to process the total bore surface of the borehole bottom 20, if the drill leg 10 is rotated.

The head 25 of the percusion tool 18 is a plate containing receiving means in the form of continuous bore for the shafts of the bore crowns 26*a* to 26*d*. In FIG. 2, the bore crown 26*a* projects by means of a hexagonal shaft 28 through a hexagonal bore 29 of the head 25. At the back of the head 25, it is locked with a disk 30 and a pin 31 passing transversely the shaft 28.

At the front side of the head 25, the bore crown 26*a* is supported by the thicker bore crown head 32. At the front side of the bore crown head, there are provided hard metal elements 33. In all of the disclosed embodiments, the impact transfer surfaces of the head 25 of the hammer body 18 and of the smaller bore crowns 26*a* to 26*d*, are designated with 34, which transfer surfaces are resting areally against one another. In the bore crown 26*a* the front end wall of the head 25 and the rear wall of the bore crown head 32 act as impact transfer surfaces 34.

The shaft of the bore crown 26*b* of FIG. 2 consists of two consecutively arranged cylindrical portions 35*a* and 35*b*, the front portion 35*a* having a greater diameter to pass over via an oblique annular shoulder 36*b* into the rear portion 35*b*. In this case, the impact transfer surfaces 34 are formed by the annular shoulder 36 and a correspondingly shaped annular shoulder within the stepped bore 37 of the head 25. The bore crown head 32 situated outside the bore 37 at a distance carries pin-shaped hard metal elements 33. The bore crown 26*b* is secured by a screw 39 passing through a disk 38 supported at the rear side of the head 25 and screwed into an axial thread bore of portion 35*b* of the shaft, thus firmly pressing against each other the impact transfer surfaces 34.

In the embodiment of FIG. 5, the bore crown 26*e* comprises a cylindrical shaft 41 which is inserted in a cylindrical bore 40 of the head 25. Through a tangential groove 42 of the shaft 41 extending in longitudinal direction and a semicircular tangential groove of the bore 40, there is passed a pin 43 which is limiting in axial direction the movements of the shaft 41. In other words, the axial play of the shaft 41 is limited. Within the range of said play, the impact transfer surfaces 34 are resting against each other at the front side of the head 25 and at the rear side of the bore crown head 32.

The bore crown 26*f* shown in FIG. 4 is substantially similar to the bore crown 26*b* of FIG. 2. Again, the impact transfer surfaces 34 are formed by a conical annular shoulder 36 inside the head 25 or between the portions 35*a* and 35*b* of the bore crown shaft. However, in the embodiment of FIG. 4, the fixing means consists of a pin extending tangentially relative to the portion 35*b* and, placed, as in the embodiment of FIG. 5, into suitable grooves of head 25 and of the bore crown shaft to allow an axial play of the bore crown shaft, thus ensuring that the impact transfer surfaces 34 fully rest against one another.

The bore crown 26*g* of FIG. 6 has a shaft 28 of a hexagonal cross section and inserted into a bearing sleeve 47 having a hexagonal recess profile, to prohibit its rotation in the bearing sleeve 47, which, however, by itself can be rotated in a bore 44 of the head 25 thus permitting to the bore crown 26*g* to freely rotate together with the bearing sleeve 47 during the drill striking operation. The bearing sleeve 47 is protected against axial displacement by a tangential pin 43 passing through a channel of the head 25 and through an annular channel 45 surrounding the bearing sleeve 47. By this means, the bearing sleeve, while being able to rotate, cannot be displaced substantially in longitudinal direction. Through the end of the shaft 28 projecting out of the bearing sleeve 47, a pin 46 is passed by which the shaft 28 is locked at the bearing sleeve 47.

In the embodiment of FIG. 6, the impact transfer surfaces 34 formed by the rear end wall of the bore crown head 32 and the front end wall of the head 25 of the hammer body 18.

What is claimed is:

1. A drilling tool comprising a deep hole hammer carried by a drill shaft, said deep hole hammer being operated by a piston within a housing, said housing being of an outer size and configuration as defined by an outer housing surface, a hammer body having axially opposite front and rear end portions, said rear end portion being adapted to be subject to the blows of said deep hole hammer piston, said rear end portion including an outer peripheral surface, said front end portion having an outer peripheral surface disposed substantially radially beyond said rear end portion peripheral surface and said outer housing surface and imparting a plate-like configuration to said front end portion, said front end portion further including a rearward facing annular surface merging with said rear end portion outer peripheral surface and a forwardly facing annular surface opposing an associated bore hole bottom; a pair of passage means through said hammer body and opening through said forwardly facing surface respectively introducing a flushing medium through said forward end portion into a bore hole bottom through a first passage means of said pair of passage means and flushing back the drilled material from the bore hole bottom through said forward end portion through a second passage means of said pair of passage means; said first passage means being disposed generally radially outwardly of said second passage means; a plurality of axial bores opening through said forwardly facing surface and said rearward facing annular surface at positions radially outwardly of said pair of passage means, radially outwardly of said outer housing surface, and radially outwardly of said rear end portion outer peripheral surface; said plurality of axial bores also being spaced circumferentially about said rear end portion outer peripheral surface, a plurality of bore crowns each having a shaft received in an associated one of said axial bores, and each bore crown and front end portion having opposing abutting impact transfer surfaces.

2. The drilling tool as defined in claim 1 wherein each bore crown further includes a head having a front cutting surface and a rear surface, and said abutting impact transfer surfaces are defined by said crown head rear surface and said hammer body forwardly facing surface.

3. The drilling tool as defined in claim 1 wherein said abutting impact transfer surfaces are defined by a frusto-conical surface of each bore crown shaft and each axial bore.

4. The drilling tool as defined in claim 1 wherein each of said axial bores is defined by a bore portion spaced from a larger counterbore portion by a frusto-conical surface, each bore crown shaft is defined by a shaft portion spaced from a larger shaft portion by a frusto-conical surface, and said frusto-conical surfaces define said abutting impact transfer surfaces.

5. The drilling tool as defined in any one of claims 2, 3, or 4 wherein said passage means for flushing back the drilled material includes an aperture opening through said forwardly facing surface in offset relationship to the axis of said hammer body.

6. The drilling tool as defined in claim 5 including means for locking the bore crown shafts rearward of said rearward facing surface.

7. The drilling tool as defined in claim 5 wherein each bore crown shaft is mounted with longitudinal play relative to its associated axial bore.

8. The drilling tool as defined in claim 5 including means for non-rotatably securing at least one bore crown shaft to its associated axial bore, and means for permitting said one bore crown shaft to be selectively inserted in one of various rotational positions of rotation relative to its associated axial bore.

9. The drilling tool as defined in claim 5 including means for freely rotatably mounting at least one bore crown shaft relative to its associated axial bore.

10. The drilling tool as defined in any one of claims 2, 3, or 4 including means for locking the bore crown shafts rearward of said rearward facing surface.

11. The drilling tool as defined in claim 10 wherein each bore crown shaft is mounted with longitudinal play relative to its associated axial bore.

12. The drilling tool as defined in claim 10 including means for non-rotatably securing at least one bore crown shaft to its associated axial bore, and means for permitting said one bore crown shaft to be selectively inserted in one of various rotational positions of rotation relative to its associated axial bore.

13. The drilling tool as defined in claim 10 including means for freely rotatably mounting at least one bore crown shaft relative to its associated axial bore.

14. The drilling tool as defined in any one of claims 2, 3, or 4 wherein each bore crown shaft is mounted with longitudinal play relative to its associated axial bore.

15. The drilling tool as defined in claim 14 including means for non-rotatably securing at least one bore crown shaft to its associated axial bore, and means for permitting said one bore crown shaft to be selectively inserted in one of various rotational positions of rotation relative to its associated axial bore.

16. The drilling tool as defined in claim 14 including means for freely rotatably mounting at least one bore crown shaft relative to its associated axial bore.

17. The drilling tool as defined in any of claims 2, 3, or 4 including means for non-rotatably securing at least one bore crown shaft to its associated axial bore, and means for permitting said one bore crown shaft to be selectively inserted in one of various rotational positions of rotation relative to its associated axial bore.

18. The drilling tool as defined in any one of claims 2, 3, or 4, 5 including means for freely rotatably mounting at least one bore crown shaft relative to its associated axial bore.

19. The drilling tool as defined in claim 17 including means for freely rotatably mounting at least one bore crown shaft relative to its associated axial bore.

* * * * *